United States Patent [19]

Wallace

[11] Patent Number: 4,826,084

[45] Date of Patent: May 2, 1989

[54] SHEATHED JET FLUID DISPERSING APPARATUS

[76] Inventor: Norman R. Wallace, 742 Hilton Rd., Walnut Creek, Calif. 94595

[21] Appl. No.: 912,791

[22] Filed: Sep. 26, 1986

[51] Int. Cl.[4] ..... B05B 7/06

[52] U.S. Cl. ..... 239/290; 239/424; 239/412; 239/420

[58] Field of Search ..... 239/290, 291, 292, 424, 239/424.5, 420, 306, 296, 417, 418, 422, 423, 456, 459, 412

[56] References Cited

U.S. PATENT DOCUMENTS

| | | | |
|---|---|---|---|
| 541,074 | 6/1895 | Dandison | 239/417 |
| 801,360 | 10/1905 | Christensen | 239/412 |
| 1,434,238 | 10/1922 | Weber | 239/417 X |
| 2,219,119 | 10/1940 | Schumann et al. | 239/417 |
| 3,093,314 | 6/1963 | Meyer | 239/417 |
| 3,610,537 | 10/1971 | Nakagawa | 239/424.5 X |
| 3,615,053 | 10/1971 | Pease et al. | 239/424.5 X |
| 4,134,547 | 1/1979 | Gamst | 239/404 |
| 4,592,509 | 6/1986 | Moss | 239/424 |

FOREIGN PATENT DOCUMENTS

| | | | |
|---|---|---|---|
| 1944309 | 3/1971 | Fed. Rep. of Germany . | |
| 608902 | 5/1978 | U.S.S.R. | 239/428.5 |

*Primary Examiner*—Andres Kashnikow
*Assistant Examiner*—Kevin P. Weldon

[57] ABSTRACT

Two concentric, liquid jets are discharged from a fluid spray apparatus into ambient gaseous surroundings to achieve either one of two purposes:

1. sheath a high-speed, inner core jet with a low speed annular sheath jet against turbulence break-up through interaction with the surrounding air.
2. cause the annular sheath jet to impact on the central core jet with radial momentum as dictated by the controlled pressure differential across the sheath jet and the distance-of-travel between the inner surface of the sheath jet and the surface of the core jet. The angle of spray and the velocity distribution throught the spray is determined by the relative velocities of the core jet and sheath jet and by the radial momentum developed in the sheath jet through variations in the pressure differential acting on it.

3 Claims, 5 Drawing Sheets

SHEATHED JET FLUID DISPERSING APPARATUS

BACKGROUND OF THE INVENTION

1. Field of Invention

The present invention concerns the jet spray dispersal of fluid from a nozzle structure for purposes such as irrigation or fire fighting when water or fire suppressant chemicals are used as the fluid medium. However, the invention also has application in such diverse areas as hydraulic excavation, combustion and deflagration initiation from a distance or in other areas of technology where changes of state or chemical reactions in the sprayed fluids are beneficial to the purpose of the application. Examples of these applications will be brought forward in the detailed description to illustrate the versatility of the invention.

2. Description of the Prior Art

Jet sprays produced by nozzles or orifices are well known in irrigation and fire fighting technology. These jet sprays are ejected from single nozzles. A plurality of nozzles or orifices may be used, sometimes on near parallel axes to give intermediate and close-in water coverage in conjunction with longer trajectory jet patterns. But single jet sprays have a common problem. They interact with the surrounding air to produce free turbulence, especially at the outer perimeter of the jet. This turbulence successively strips liquid from the outer layer of the jet pattern causing loss of mass from the main jet and otherwise adversely affecting the jet. This circumstance is not intolerable in irrigation applications where jet spray is intended to drop out along the trajectory. Nevertheless, the jet nozzle configuration must usually be designed for a given range and water drop out as a function of distance from the nozzle for some limited range of water pressure. If the pressure lies outside this design range, the nozzle performance deteriorates significantly.

Deterioration by free turbulence of a jet spray in firefighting is undesirable; because, by the nature of this application, the spraying equipment must stand off from the target. Liquid loss between the nozzle and the target reduces efficiency.

SUMMARY OF THE INVENTION

This invention consists of an apparatus for forming dual, coaxial jets issuing from a nozzle structure. The inner, or core jet, is surrounded by an annular sheath jet. In most applications, the two jets would issue from the nozzle structure at different speeds. They could be fed from separate pressurized fluid sources or from the same source with the flow into one of the jets choked to achieve the desired velocity difference.

The coaxial jets issue from the nozzle structure with their water-particle velocity vectors co-parallel and parallel to the central axis; this prevents lateral dispersion of the jet spray which would result if there were an initial water particle momentum normal to the jet axis. In applications where lateral dispersion is desired, such as in irrigation, lateral momentum is initiated and controlled in this invention by manipulating the static pressure in the toroidal cavity between the jets at their point of issuance from the nozzle structure. When the cavity pressure is reduced below atmospheric, the sheath jet is accelerated radially inwards by the pressure difference to implode on the core jet. Since radial momentum is conserved, fluid will rebound radially outwards from the initial point of contact and with the same momentum to establish the desired angle of jet dispersion.

The automatic reduction of cavity pressure with reduction in line pressure is treated in this invention description. The result is a semi-automatic transition from no dispersion in the dual jet to a condition of hydraulically controlled spray dispersion as total line pressure is changed. By adding an indexing device to change the speed of rotation of the jet system about a vertical axis as line pressure changes and by adding a pressure-actuated elevation control to the nozzle structure, a completely-automatic, pressure-controlled irrigating spray system can be produced. The system could be programmed to irrigate an irregular area with virtually any prescribed fluid dropout over sectors of that area subject to certain restraints on the geometry of the area relative to the location of the fluid dispersing nozzle.

Other applications of the dual jet concept arise when chemical reactions and other thermodynamic functions, like change of state, are introduced between the jetted fluids.

DETAILED DESCRIPTION OF THE PREFERRED EMBODIMENTS

Figure 1:
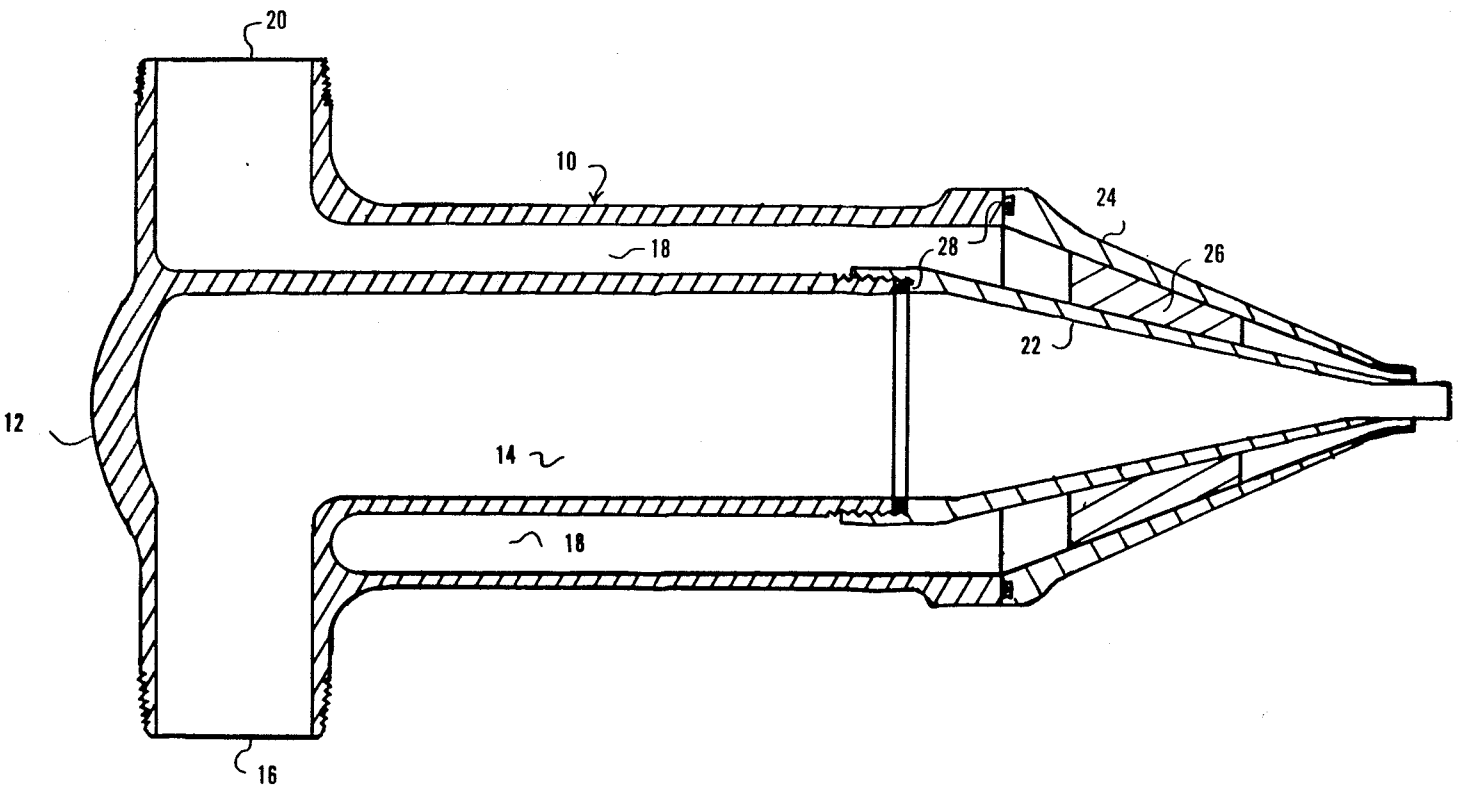
FIG. 1 is a horizontal section through a first embodiment of the sheathed jet apparatus in which the nozzle structure is fixed to bring inner and outer jet fluids into contact in the free stream with no lateral momentum imparted to the fluids.

FIG. 1 shows a simple embodiment of the apparatus of the invention broadly denoted by the numeral 10. Base piece 12 of apparatus 10 contains a central chamber 14 into which fluid for a core jet is introduced through fluid inlet port 16. Base piece 12 also contains an annular chamber 18 surrounding chamber 14 and supplied with sheath jet fluid through fluid inlet port 20. Each chamber has a nozzle section which directs fluid in the form of a jet from the chambers 14 and 18 into the surroundings. The nozzle section for the central chamber 14 is designated by the numeral 22 and the nozzle section for annular chamber 18 is designated by the numeral 24.

A combination annulus flow straightener and centering guide 26 is in chamber 18 near the nozzle section 24 thereof and operated to maintain nozzle section 22 centered in nozzle section 24 while removing any residual rotation in the fluid flow exhausting from annular chamber 18.

Nozzle sections 22 and 24 may be integrally attached to flow straightener and centering guide 26 to form a one-piece attachment to base piece 12. Gaskets 28 at the junctions shown in FIG. 1 can be selected so as to be suited to the operating pressure and temperature service of the apparatus.

Figure 2C:
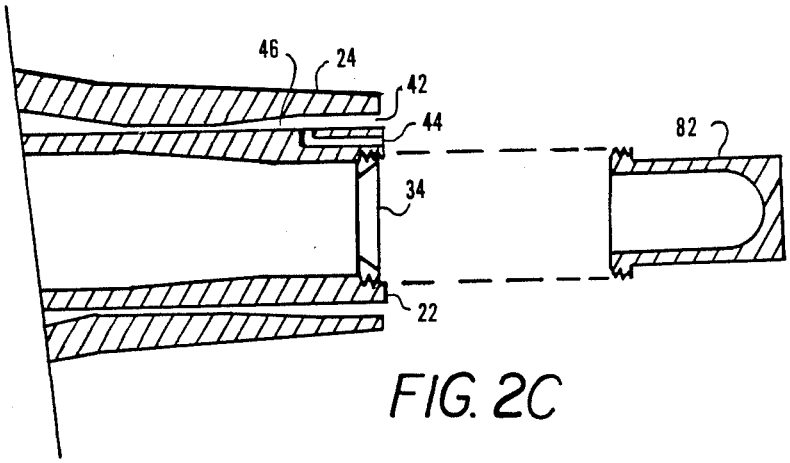
FIGS. 2B and 2C are views similar to FIG. 2A and illustrate structural properties of the variable nozzle.
Figure 2B:
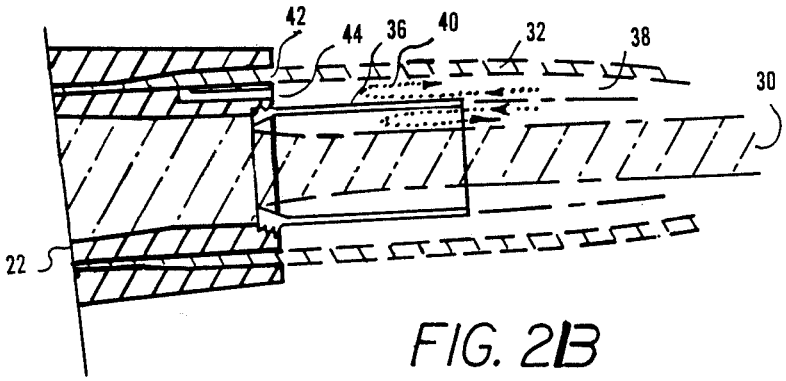
Figure 2A:
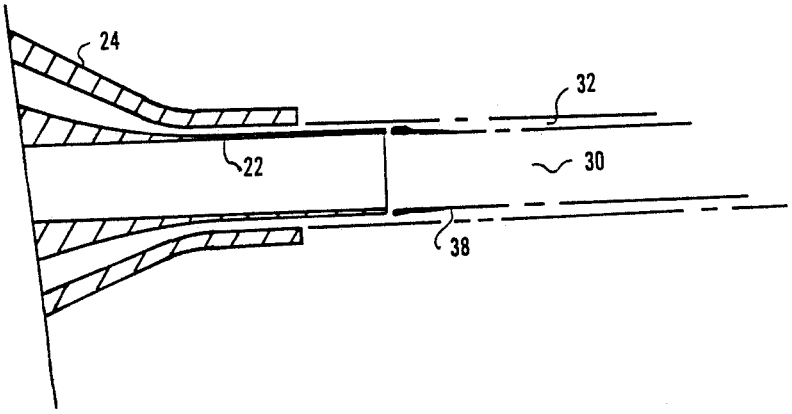
FIG. 2A is a schematic view of the fixed nozzle enlarged.

The discharge section of the combined nozzle structure formed by nozzle sections 22 and 24 is shown in FIG. 2A. Nozzle sections 22 and 24 are so tapered as to make a core jet 30 of fluid and a sheath jet 32 of fluid parallel with each other when they emerge from their respective nozzle sections. In most of the expected applications of the fixed-nozzle configuration of the present invention, the velocity of core jet 30 will be significantly different from the velocity of sheath jet 32 with the core jet 30 being at a higher velocity.

When real fluids travelling parallel to each other but at different velocities are brought into intimate contact they are, at first, separated by a vortex sheet of infinitesimal thickness. As time passes and the two fluids of dissimilar velocities continue on their mutual trajectory, the vorticity at their interface diffuses into both the sheath jet 32 and the core jet 30. This diffusion of vorticity causes the core jet 30 to decrease in speed while the sheath jet 32 gains speed until all the fluid in the two jets combined has the same velocity.

The time to full equalization of velocity throughout the two jet elements forming a combined jet is very long compared to the time it takes for an element of the core jet to reach the terminus of the trajectory. This means that the two jets will remain in time-unsteady interaction throughout their times of flight.

The differential equation describing the velocity distribution in an arbitrary cross-section of the combined jets is the same as the equation for heat conduction in a solid with an insulated outermost boundary and with initial conditions comprised of a given temperature in the core cylinder and some different temperature in the annular cylinder surrounding the core cylinder. This circumstance introduces thermodynamic applications for the sheathed jet concept of the present invention.

Suppose, for example, that liquid ammonia is introduced into annular chamber 18 while liquid water near its freezing temperature is injected into central chamber 14. Insulation can be provided between these chambers or the initial temperatures of the two liquids could be adjusted to prevent freeze-up within the apparatus of FIG. 1. When the two jets combine at a location external to the nozzle structure, heat exchange between the jets as well as velocity exchange between the jets will begin. The liquid ammonia will also exchange heat and velocity with its ambient surroundings, but the relative mass discharges of water and ammonia can be chosen to freeze an outer crust of ice on core jet 30 while sheath jet 32 evaporates leaving partially-frozen core jet 30 free to continue on trajectory with much of its original momentum intact.

In applications of the sheathed jet concept where changes of state take place in the jet fluids, neither fluid should boil at the interfacial temperature, because the dual-jet structure would be adversely affected. This requirement can be fulfilled in the liquid ammonia-water example given above.

As a second thermodynamic example of the sheathed jet concept, consider a first liquid to be ejected as core jet 30 which chemically reacts with oxygen. A second liquid can be ejected as sheath jet 32 which is inert in the presence of both oxygen and the material of core jet 30. Proper choice of the separate jet velocities and mass flows in the two jets can allow full sheathing of core jet 30 until the combined jet arrives at the target point. There, splash of both jet components will expose core jet material to the atmosphere and initiate a reaction which continues so long as the jet system is in operation.

In startup and shutdown for this kind of operation, a purge fluid should be used in the core jet until the quasisteady flow is achieved (or stopped). This would insure that the reactive fluid would not be left in chamber 14 when it is not operating.

The sheathing action of jet 32 depends to large extent on its velocity. At a very low exit velocity in jet 32, the interface between this jet and the surrounding atmosphere will be hydrodynamically stable. But as the velocity of the fluid at this interface increases due to the interaction between jet 32 and the faster core jet 30, instabilities will originate and grow into fully developed free turbulence. Depending upon the application, velocities and flowrates in the separate jets 30 and 32 may be chosen to optimize the performance of the system.

Referring to the examples above, a chemically reactive core jet may require the protection of an intact sheath jet over the entire trajectory. However, the liquid ammonia/water example requires an ammonia sheath only for a time period long enough to produce adequate structural strength in the ice encapsulation of the core jet.

A numerical example will illustrate these points. Consider a dual jet system in which both core and sheath jets consist of water at the same temperature of about 20° C. The cross sectional areas of the jets are equal. The initial velocity of the core jet is 94 ft/sec while the initial velocity of the sheath jet is choked to 10 ft/sec. The mean velocity of the combined flows, 52 ft/sec determines the trajectory. Ignoring air resistance, the maximum horizontal range is about 84 feet, and the distance along the trajectory is about 120 feet. The time of flight of a water particle travelling at the mean velocity of 52 ft/sec is about 2.3 seconds. This happens to be the velocity of particles in the interface of the two jets. The interface adopts the mean velocity immediately upon contact of the two jets and remains at that velocity throughout the motion in the case of the cross sectional areas of the jets being equal.

The velocity at the center of the core is 94 ft/sec initially and will decrease to only 91 ft/sec after 2 seconds of flight. A water particle at the center of the core jet actually traverses the 120 feet of trajectory in about 1.3 seconds at an average speed of 92 ft/sec.

A particle on the outer surface of the sheath jet starts the trajectory at a speed of 10 ft/sec and is accelerated to 35 ft/sec in 5 seconds. This particle traverses the trajectory distance in about 5 seconds at an average speed of approximately 24 ft/sec.

If undesirable levels of turbulence develop in the sheath jet as its speed increases, the initial velocity can be reduced, the jet thickness can be increased or its viscosity can be decreased by pre-heating the water. In the first alternative, decreasing the initial velocity of the sheath jet from 10 ft/sec to 2 ft/sec only reduces the mean velocity of the jet from 52 ft/sec to 48 ft/sec.

For use of apparatus 10 in agriculture, a fully-sheathed core jet as described above would have only limited applications such as for spraying insecticides or fertilizers into some distant location without intermediate dropout.

Irrigation requires the continuous dropout of water from the nozzle to the range limit of the spray according to some preselected distribution schedule in the irrigated zone. With a different nozzle configuration, the sheathed jet system is ideally suited to this function. Such a nozzle configuration is shown in FIGS. 2B and 2C. Nozzle section 22 is movable relative to nozzle section 24 along their common axis of symmetry.

Nozzle section 22 is shown to be fitted with a sharp-edged orifice 34 in FIG. 2C. In FIG. 2B, this orifice is shown with a splitter cylinder 36 attached in any suitable manner. This splitter cylinder is an optional item. It does not interfere with the flow of jets 30 and 32 but will serve to stabilize the vortex cells in vortex cavity 38 between the two emerging jets. Its more important function would be to reduce mixing between liquid components of jets 30 and 32 in the vortex cavity 38.

A vortex cavity 38 attaching to the nozzle is also associated with the fixed nozzle structure of FIG. 2A as indicated. The volume of the vortex cavity in FIG. 2A is much smaller than that in FIG. 2B and, therefore, its vorticity is much more intense. The circulation in vortex cavities 38 should be about the same for both nozzle types. In both cases, the cavity circulation is held constant in the presence of viscous dissipation by the steady jet streams 30 and 32. The directions of rotation are shown by the dotted lines and arrows 40 in FIG. 2B.

Once the fluids in jets 30 and 32 have left the vicinity of the vortex cavity 38, they are still separated by a vortex sheet at their mutual interface; but this vorticity is not maintained as was discussed earlier. It diffuses into the two jet flows and dissipates with the result that the jet velocities are equalized over time and kinetic energy is lost through the action of viscous shear.

The annular exit passage 42 for sheath jet 32 has straight-sided walls at the nozzle exit. Upstream from the exit passage, the inside wall of nozzle section 24 is tapered towards the nozzle axis to produce a venturi effect in the interior flow of sheath jet 32. Since the static pressure in the straight-sided portion of the exit passage 42 is atmospheric, the pressure in venturi section 46 is reduced below atmospheric in accord with Bernoulli's theorem. A static pressure port 44 in nozzle section 22 opens into exit passage 42 and into vortex cavity 38. Thus, when the static port is in the straight-sided section of the exit passage, the static pressure in the vortex cavity 38 will be atmospheric. When nozzle section 22 is moved inwards relative to nozzle section 24, the static pressure port moves into venturi section 46 causing a corresponding reduction in the vortex cavity pressure. This pressure reduction leads to a pressure differential across cylindrical sheath jet 32 and the jet is accelerated radially towards the common jet axis. The radial momentum of jet 32 is determined by the radial velocity at the time of impact of jet 32 with jet 30. Since momentum is conserved, the impact results in a radially outwards flow which, when vectorially combined with the axial momemtum of the two jets, produces a spray pattern.

The axially symmetric velocity distribution over a section through the spray pattern is established by choosing the separate jet velocities. If the velocities are equal in core jet 30 and sheath jet 32, the velocity distribution in the spray will be uniform. When the velocities are made unequal, the velocity distribution can be highest at the periphery of the spray cone or at the axis.

The angle of the spray cone is determined by the pressure in the vortex cavity 38 and the radial distance of travel between the inside surface of sheath jet 32 and the outside surface of core jet 30.

A very wide angle spray can be obtained from the sheath jet 32 alone by closing off core jet 30 altogether. Orifice 34 in FIG. 2C is replaced by rigid cylindrical insert 82. Then with reduced pressure in vortex cavity 38, sheath jet 32 will reflect from insert 82 with a coefficient of restitution of almost one. A high velocity radial spray with low axial velocity produces a wide spray angle.

An example will be clarifying. Suppose core jet 30 has a speed of 94 ft/sec and sheath jet 32 has a speed of 10 ft/sec as used above. Say FIG. 2C is full scale, so dimensions can be read directly. Take the pressure difference across the sheath jet to be 1/10 atm. That is, vortex cavity 38 pressure is 9/10 atm. It can be calculated that the radial velocity of sheath jet 32 at the time of impact with core jet 30 is 31 ft/sec. The combined mass of core jet 30 and sheath jet 32 has a mean velocity of 52 ft/sec. Half of this total mass, that of sheath jet 32, has a radial velocity of 31 ft/sec to produce a resultant momentum cone half angle of 16.7°. If the core jet is replaced with cylindrical insert 82, only sheath jet 32 contributes to axial momentum; and the resultant momentum cone half angle is 72.3°.

Figure 3:
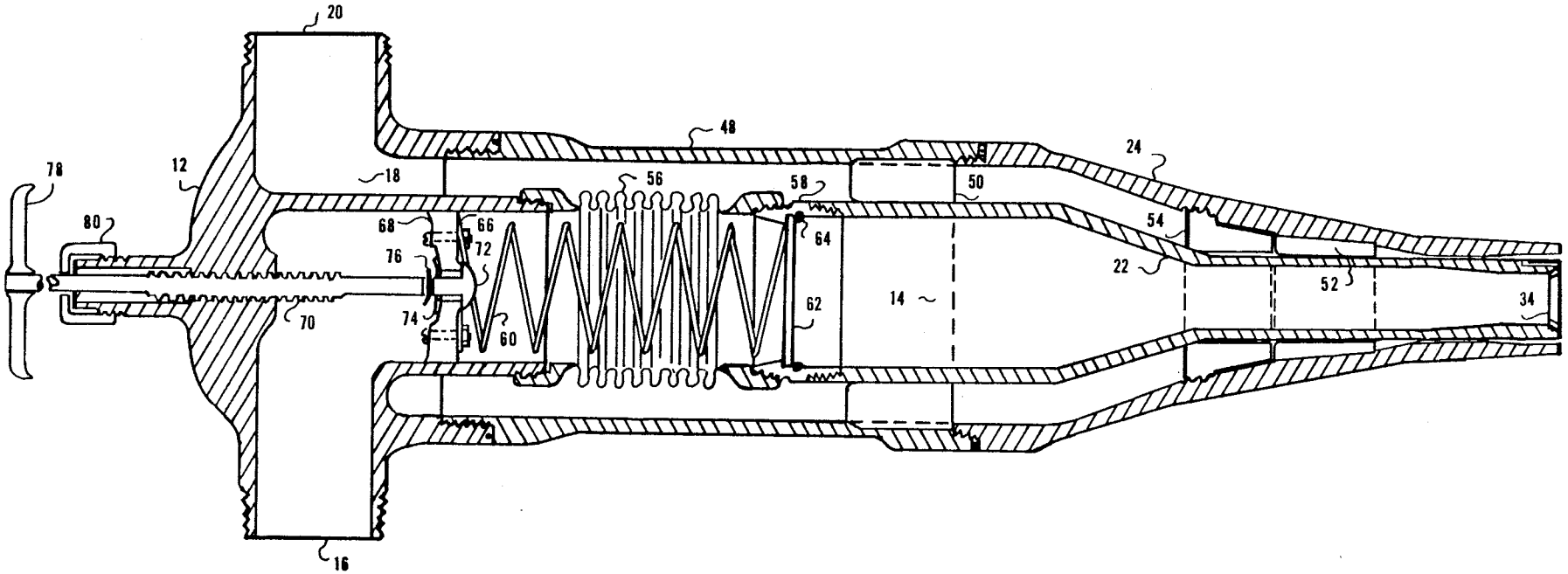
FIG. 3 is a vertical cross section of the complete apparatus utilizing the variable nozzle to change the dispersion of the jet pattern as the fluid line pressure changes.
Figure 4:
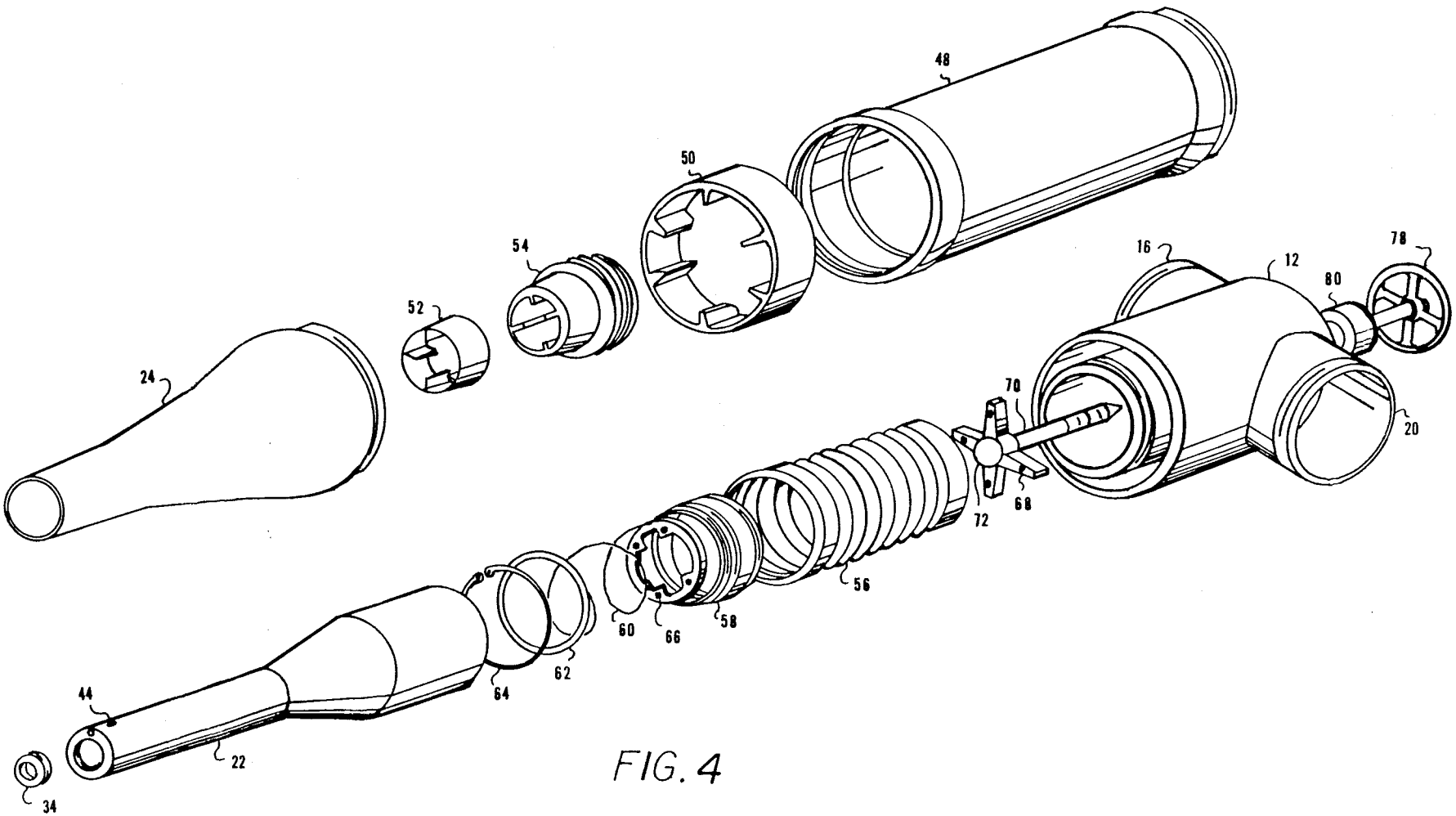
FIG. 4 is an exploded view of the apparatus of FIG. 3, and illustrating the assembly and structural details of the component parts.

A complete sheathed jet spray gun is shown in horizontal cross section in FIG. 3 and in an exploded assembly view in FIG. 4. This spray gun incorporates the hydraulic features discussed in the previous paragraphs and is designed to automatically increase the spray cone angle as the total line pressure is reduced. This feature anticipates a completely automatic, pressure programmable irrigation head to be discussed at the end of this section.

The irrigation spray gun has several components in common with the fixed nozzle apparatus of FIG. 1. These are: a base piece 12 with inlet ports 16 and 20, central chamber 14 and annular chamber 18 together with nozzle sections 22 and 24.

Nozzle section 24 attaches to base piece 12 via barrel 48.

Since nozzle section 22 moves longitudinally with respect to fixed nozzle section 24, two alignment guides are provided: a central guide 50 press-fitted into barrel 48 and a forward guide 52 press-fitted into nozzle section 24. These guides maintain the walls of the annular exit passage concentric and insure linear motion in nozzle section 22.

Stop 54 screws into nozzle section 24. This stop prevents overextension of nozzle section 22 due to high pressure in central chamber 14.

The inner barrel assembly consists of nozzle section 22 which attaches to base piece 12 through a bellows 56 and connector nipple 58. Tension spring 60 has two spring bases. Spring base 62 is held inside connector nipple 58 by retainer 64. Spring base 66 is attached to cruciform guide 68 which slides loosely inside the inner barrel of base piece 12.

Threaded rod 70 threads into base piece 12 and turns freely in cruciform guide 68. End cap 72, washer 74 and cotter pin 76 hold the cruciform guide 68 in position at one end of the threaded rod 70. Rotating threaded rod 70 changes the axial position of cruciform guide 68 and thereby increases or decreases spring tension on nozzle section 22. This rotation is done external to the apparatus by means of handle 78 splined onto threaded rod 70.

The penetration of threaded rod 70 into base piece 12 is sealed against leakage by packing held in place by packing nut 80. "0" rings may be used as an alternate means of sealing.

The apparatus shown in FIGS. 3 and 4 and described above is only one member of a family of irrigating spray guns that can be assembled from the same basic parts. The system described above is predicated on the assumption that the pressure in central chamber 14 will always be greater than the pressure in annular chamber 18 as the pressure in both chambers is varied. The net axial force of nozzle section 22 is obtained by integrating the axial component of pressure over the inner face of the conical part of nozzle 22 and subtracting the integral of the axial pressure component over the outer face of the same conical part. With the pressure difference always being as assumed, nozzle section 22 experiences a net force outwards. Thus, spring 60 is taken to be a tension spring.

The device would be set up for automatic variation of spray angle with changes in line pressure by first setting the spray gun at maximum operating pressure which we will assume produces maximum net outward force on nozzle section 22. Then cruciform guide 68 is manually retracted until the desired spray angle for maximum flow in the combined jets is achieved. Thereafter, reduction in total line pressure will reduce the net outward force on nozzle section 22 allowing tension spring 60 to retract nozzle section 22 and static pressure port 44 deeper into venturi section 46. The further pressure reduction that results in vortex cavity 38 increases radial momentum in the jet to expand the spray cone angle.

If the pressure is planned to be habituallly greater in annular chamber 18 than in central chamber 14, then tension spring 60 would be replaced by a compression spring to achieve the same purpose intended in the detailed specification.

Still another member of this family of devices contains no spring at all. Threaded rod 70 would be extended to the position of spring base 62 and mechanically attached to nozzle section 22. Then the location of static port 44 would always remain in the manually set position desired in venturi section 46. Reduction in line pressure would cause a reduction in velocity in sheath jet 32 leading to an increase in pressure in vortex cavity 38. Whereupon, the spray cone angle would decrease, because the radial momentum would decrease.

Opening static pressure port 44 into venturi section 46, as discussed above and shown in FIG. 2C, is not always the most appropriate means of controlling radial momentum in sheath jet 32. It is certainly suitable for low speed sheath jets as described heretofore; but for high sheath jet speed, pressure drop in vortex cavity 38 becomes too sensitive to control.

Figure 5B:
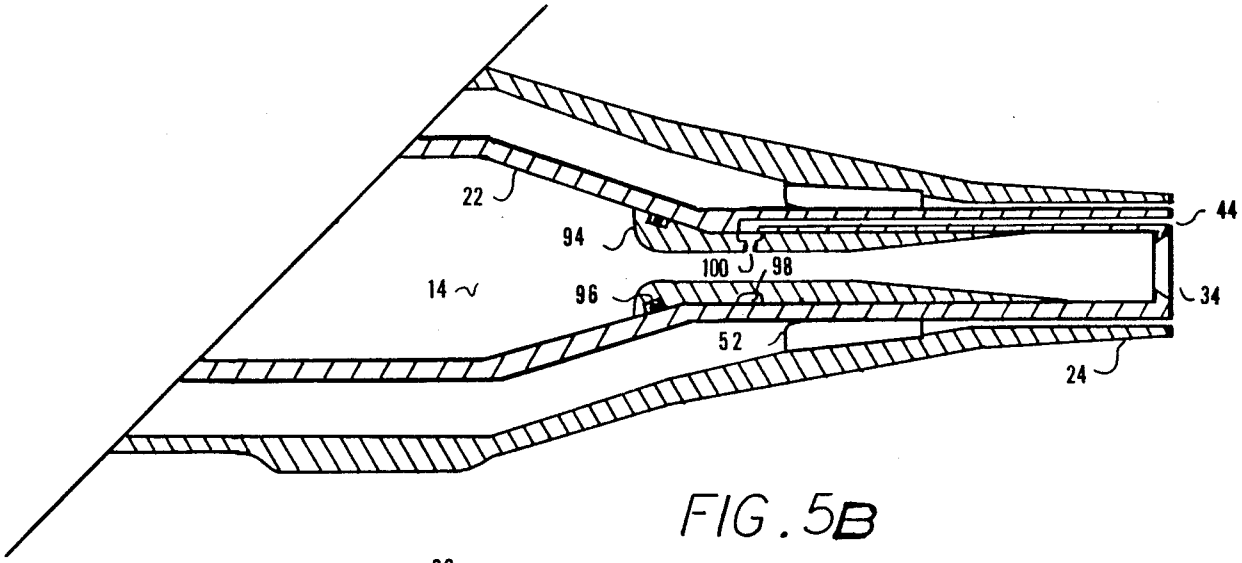
FIGS. 5A and 5B illustrate in sectional view alternate means of controlling and communicating static pressure to the vortex cavity.
Figure 5A:
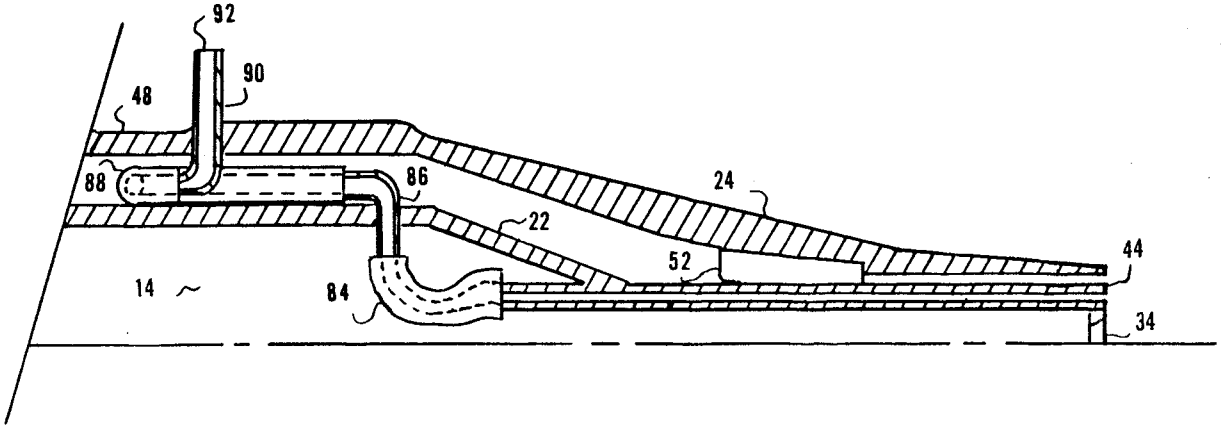

Alternative means of pressure communication to vortex cavity 38 are shown in FIGS. 5A and 5B.

FIG. 5A is a cross-section of a symmetrical half of the forward section of apparatus 10 showing nozzle sections 22 and 24 with static pressure port 44 built into nozzle section 22. Venturi section 46 of FIG. 2C is eliminated. Nozzle section 22 is rigidly fixed and no longer free to move longitudinally, so stop 54 and central guide 50 can be eliminated. Forward guide 52 is retained to center nozzle section 22 within nozzle structure 24.

Pressure port 44 is now shown to open into central chamber 14 where rigid or flexible tubing 84 continues the static pressure conduit to pressure-tight wall penetration 86 in nozzle section 22. Flexible tubing 88 further continues the static pressure conduit to pressure-tight wall penetration 90 through barrel 48 which is located upstream of the threaded connection between nozzle structure 24 and barrel 48. This permits assembly of the apparatus, since the final connection of the static pressure conduit is made between flexible tubing 88 and wall penetration 86 before nozzle structure 24 is attached to barrel 48.

Once entry 92 to vortex cavity 38 is made exterior to apparatus 10, numerous means of vortex cavity pressure control become available. Among these means is the direct use of a pressure regulator on a bypass line from the feed piping to the apparatus.

For very high velocities in core jet 30 or sheath jet 32, the problem becomes one of holding the desired static pressure in vortex cavity 38 by continuously supplying makeup fluid through the static pressure conduit. Instead of maintaining rotational flow in the vortex cavity, a highspeed jet system can empty the cavity by entrainment of the fluid particles therein. The cavity pressure would then be the vapor pressure of the jet liquid. For water at room temperature, this pressure is only 0.35 psia.

Makeup fluid can be metered into the vortex cavity through inlet port 92. If friction loss in the static pressure conduit is too great to meet the required liquid volume flowrate, air or steam could be substituted to maintain the desired vortex cavity pressure.

FIG. 5B shows still another alternative means for vortex cavity pressure control. Static pressure port 44 is made to open into central chamber 14. A venturi insert piece 94 is press-fit into nozzle section 22. "0" ring 96 seals venturi insert 94 against intrusion of stagnation pressure from central chamber 14 into static pressure port 44.

A radial groove 98 in venturi insert 94 permits installation of venturi insert 94 without requiring rotational lineup of the insert to open static pressure port 100 to the vortex cavity via static pressure port 44.

In this arrangement, the speed of core jet 30 establishes and controls the static pressure in vortex cavity 38 of FIG. 2B, since pressure reduction induced by venturi section 94 is communicated to the vortex cavity via static pressure ports 100 and 44.

For the sake of simplicity in the irrigation application, it has been assumed in this specification that line pressure or total line pressure are directly related to the flow in the two jets. That is, one or the other flows through inlet ports 16 and 20 derives from choking one inlet flow while both flows result from a common source. If core jet 30 and sheath jet 32 are driven by independent sources, even more adaptations of the concept can be developed.

Applications are further multiplied by introducing thermodynamic and heat transfer considerations as discussed for the fixed nozzle configurations.

Analyses have been done to derive the performance evaluations described herein, and these analyses are the source of the several quantities put forward in this specification. Detailed performance parameters can be developed by direct experimentation.

Whole new areas of utility for this concept are suggested when the central chamber 14 pressures are increased to 8200 psi and beyond, the supersonic jet range.

New areas of application can be appreciated for unusual material like carbon dioxide which sublimes from the solid phase to the gaseous phase at atmospheric pressure but which can be made to create carbon dioxide snow in a sheath jet. This material, carried into a confined space by a high velocity core jet of partially frozen water could act as a very effective fire suppressant.

It has been seen that the dispersion angle of an irrigation spray can be controlled by pressure variations in central chamber 14 and annular chamber 18 to cause axial movement in nozzle section 22. It would be a simple matter to extend this automatic feature to the development of a fully automatic sprinkler head capable of irrigating an irregular area with uniform water drop-out. The dual nozzle monitor assembly would be equipped with a piston-actuated nozzle elevation control. Pressure taps off the feed lines to inlet ports 16 and 20 would be led to opposite sides of the elevation control piston. The piston would act against a spring so that the required equilibrium positions would result as the hydrostatic pressures to inlet ports 16 and 20 are varied.

An additional apparatus on the monitor is required to change the speed of rotation of the nozzle about the vertical axis as the flowrate through the nozzle changes.

The entire assembly including spray gun and monitor can be made to withdraw into a subgrade compartment with a cover under shut-off conditions to provide vandal-resistant protection.

There are too many independent variables in the system described to give detailed examples of the system operation here. Moreover, some of the functional relationships would require experimental evaluation as, for example:

(1) mean droplet size as a function of spray dispersion angle and sheath jet/core jet velocities.

(2) total liquid drop-out as a function of ground elevation in particular modes of spray dispersal from the invention.

However, some salient principles can be described:

If there are obstacles or areas not to be irrigated between the spray gun and the irrigation target, sheath jet velocity would be decreased to minimize spray dispersion (nozzle 22 moves forward) and to prevent liquid drop-out until the water particles are on the last stages of the trajectory.

When the radius to the outer edge of the irrigated area decreases, line pressure is decreased to increase dispersion angle, spray gun elevation is increased to increase the range under reduced pressure conditions and speed of rotation of apparatus 10 about a vertical axis is increased to maintain uniformity of liquid drop-out.

With its versatility and multiplicity of applications, this invention should have widespread usage. Some examples have been given in this specification, but many more will occur to the skilled and knowledgeable reader. Accordingly, the scope of the invention should be determined not by the embodiment(s) presented, but by the appended claims and their legal equivalents.

What is claimed is:

1. Fluid delivery apparatus comprising;

means defining a central chamber and an annular chamber, each chamber having an inlet and an outlet; each chamber being adapted for receiving pressurized fluid through the inlet thereof; each chamber outlet having nozzle structure, separate fluids exiting through the nozzle structures without making mutual contact and issuing from said nozzle structure as concentric jets of fluid, the core jet deriving from said central chamber and the encircling sheath jet deriving from said annular chamber, the velocity of said core jet and the velocity of said sheath jet being determined through manipulation of the fluid pressures in said central chamber and said annular chamber, said core jet nozzle structure is movable relative to said sheath jet nozzle structure, a static pressure port is included in said core jet nozzle structure to communicate pressure between an entrance in said sheath jet nozzle structure and said vortex cavity and a venturi section is included in said sheath jet nozzle structure so that pressure changes will be communicated to said vortex cavity as the entrance to said static pressure port changes location within said venturi section for changing radial momentum in said sheath jet.

2. Apparatus according to claim 1 which includes a spring to maintain said core jet nozzle structure in a first position as a result of pressure changes in said central chamber and said annular chamber.

3. Fluid delivery apparatus comprising;

means defining a central chamber and an annular chamber, each chamber having an inlet and an outlet; each chamber being adapted for receiving pressurized fluid through the inlet thereof; each chamber outlet having nozzle structure, separate fluids exiting through the nozzle structures without making mutual contact and issuing from said nozzle structure as concentric jets of fluid, the core jet deriving from said cental chamber and the encircling sheath jet deriving from said annular chamber, the velocity of said core jet and the velocity of said sheath jet being determined through manipulation of the fluid pressures in said central chamber and said annular chamber, said core jet nozzle structure is movable relative to said sheath jet nozzle structure, a static pressure port is included in said core jet nozzle structure to communicate pressure through said sheath jet nozzle structure and between said vortex cavity and said central chamber, wherein said static pressure port opens into a venturi insert in said core jet nozzle structure.

* * * * *